United States Patent [19]

Anderberg et al.

[11] 4,095,746

[45] Jun. 20, 1978

[54] SELF-SUPPORTED WATER SWEEPER

[76] Inventors: Thomas A. Anderberg; Richard Petrillo, both of 1031 62nd St., Oakland, Calif. 94608

[21] Appl. No.: 763,975

[22] Filed: Jan. 31, 1977

[51] Int. Cl.[2] ..... B05B 1/20

[52] U.S. Cl. ..... 239/287

[58] Field of Search ..... 239/287, 565; 16/38, 16/39; 56/400.15

[56] References Cited

U.S. PATENT DOCUMENTS

| | | | |
|---|---|---|---|
| 1,779,036 | 10/1930 | Dutton | 239/287 X |
| 2,595,933 | 5/1952 | Gilbertsen | 239/287 |
| 2,746,072 | 5/1956 | Lumpkin | 239/287 X |
| 3,118,607 | 1/1964 | Rocher | 239/287 X |
| 4,009,666 | 3/1977 | Russell et al. | 239/287 X |
| 4,022,382 | 5/1977 | Engdahl | 239/287 |

FOREIGN PATENT DOCUMENTS

| | | | |
|---|---|---|---|
| 2,242,062 | 2/1974 | Germany | 239/287 |

*Primary Examiner*—Johnny D. Cherry
*Attorney, Agent, or Firm*—Flehr, Hohbach, Test, Albritton & Herbert

[57] ABSTRACT

A water sweeper for coupling to a hose connected to a water supply under pressure has a handle member including a manually operated valve. The handle member has a handle passage therethrough and the valve selectively blocks and passes water from the supply to the handle passage. The handle is held by an operator at the valve end and is connected to a cross member at the other end. The cross member extends to either side of the handle member having a cross passage therein which is sealed at each end of the cross member by end caps. Support means, such as casters, are mounted on the cross member toward each end thereof for supporting the cross member for substantially friction-free movement in any direction on an underlying surface. A plurality of spray nozzles communicating with the cross passage are mounted in the wall of the cross member with each emitting a flat spray pattern toward the underlying surface. The flat spray patterns overlap at the underlying surface for a predetermined elevation of the handle. Ones of the spray nozzle are located sufficiently close to each end of the cross member to reach a point on the underlying surface laterally beneath the extreme ends of the end caps so that the underlying surface may be entirely swept even when there are obstructions at the edges thereof. Another spray nozzle is located at the junction of the handle and cross passage which extends into the cross passage and serves to deflect flow from the handle passage laterally toward each end of the cross passage to thereby reduce head loss at the junction.

8 Claims, 6 Drawing Figures

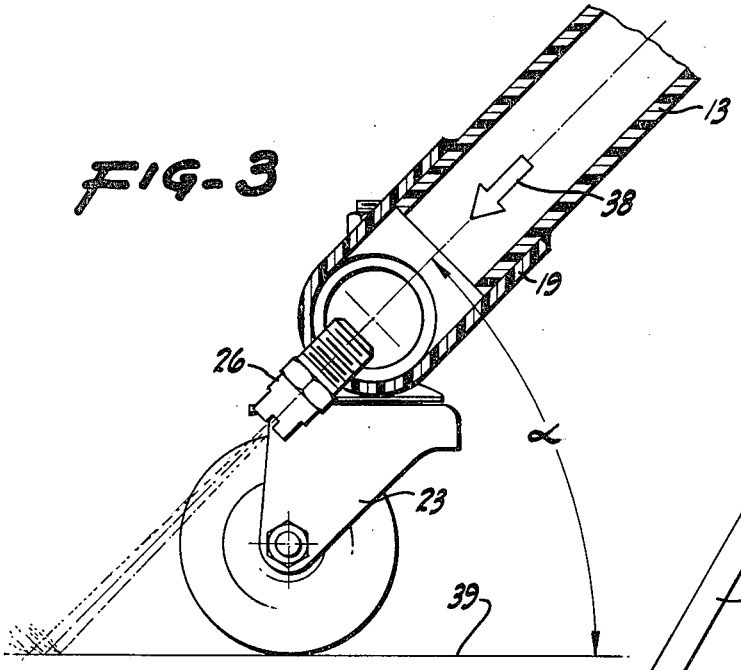
FIG-3
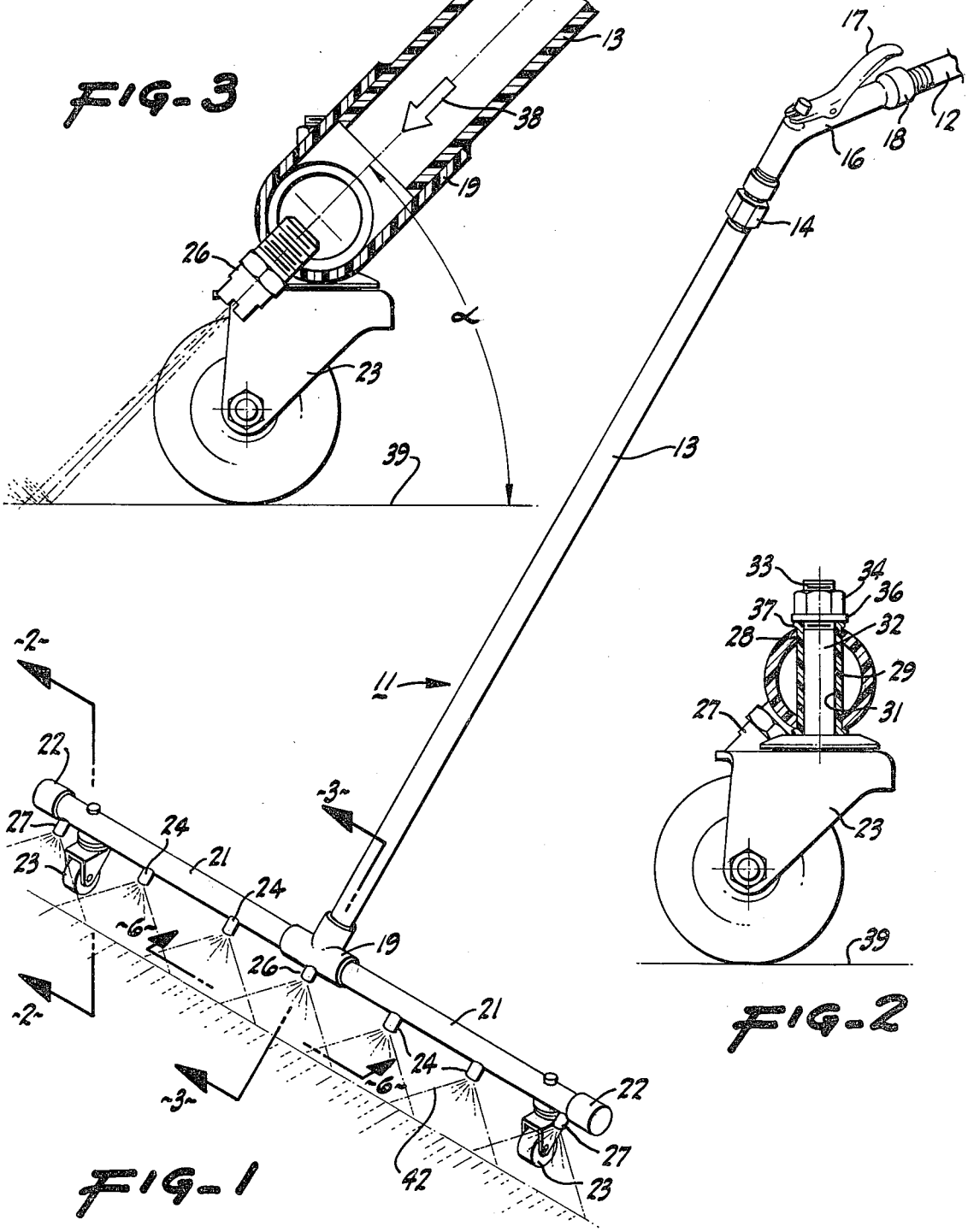
FIG-1
FIG-2

SELF-SUPPORTED WATER SWEEPER

BACKGROUND OF THE INVENTION

This invention relates to a water sweeper or broom which is self-supported on a surface to be swept and more particularly to such a water broom providing a controlled amount of water to be dispensed on the surface at a relatively constant pressure across the width of the broom.

Devices are known having manually operated valves for connection to a water supply and having a member attached to the valve which is held toward a surface upon which the water is to be directed through a nozzle at the end of the member. Such a device is completely supported by the operator's hand and the water emitting from the nozzle is used to remove debris from the surface toward which it is directed. Another device is known which consists of a metal conduit having a depending portion at the lower end of which is a portion bent laterally for a short distance after which a "U" shaped bend is imparted to the metal conduit to direct the conduit in the opposite lateral direction, thereby forming a lower crossing member. The lower crossing member is sealed at the end and has attached thereto support means, such as a pair of casters, for contacting a surface to be swept. A number of water outlets are provided in the lower crossing member between the casters and directed toward the surface. When water under pressure is directed through the conduit, head losses occur at both of the bends in the conduit and successively lower pressure is seen at each downstream outlet. Moreover, the spray pattern does not carry laterally to the ends of the lower cross member.

A water broom is needed which provides a continuous elongate jet extending across the width of the broom for direction against a surface to be cleaned, thereby requiring a minimum of water to be directed against the surface for removing debris therefrom.

SUMMARY AND OBJECTS OF THE INVENTION

In general the apparatus for cleaning a surface is utilized with a source of water under pressure having a hose coupled thereto and includes a handle member for connection to the hose at one end. A handle passage passes through the handle member and a cross member is connected to the other end of the handle member. A cross passage passes through the cross member being in communication with the handle passage at a junction between the ends of the cross member. The cross member is sealed at each end and has means attached thereto for supporting the cross member in spaced relation with the surface to be cleaned. A number of spray nozzles are mounted in the wall of the cross member having spray passages therethrough directed toward the surface. Water passing through the spray passages at substantially equal pressure provides a plurality of overlapping spray patterns creating a continuous spray pattern on the surface extending laterally to at least the ends of the cross member. Movement of the handle by an operator provides motion of the continuous spray pattern over the surface for loosening and removing debris from the surface. A valve may be included in the handle member for control of flow to thereby minimize the amount of water impinging on the surface to thereby reduce the standing water upon completion of the cleaning operation.

It is an object of the present invention to provide a self-supported water sweeper which provides a continuous spray across the width of the sweeper at substantially constant pressure thereacross.

Another object of the present invention is to provide a self-supported water sweeper through which the volume of water flow is controlled by the operator.

Another object of the present invention is to provide a self-supported water sweeper wherein the spray pattern is flat to further minimize the volume of flow directed toward the surface to be cleaned.

Another object of the present invention is to provide a self-supported water sweeper in which all parts exposed to the water flow are nonferrous to preclude rust formation, thereby obtaining a long useful life for the sweeper.

Another object of the present invention is to provide a self-supported water sweeper which is lightweight and easy to move in any direction on the surface to be cleaned.

Another object of the present invention is to provide a self-supported water sweeper which cleans the entire surface on which it is used in spite of obstructions adjacent to the edges of the surface.

Another object of the present invention is to provide a self-supported water sweeper in which the pressure in each of a plurality of coalescing jets is substantially equivalent.

Additional objects and features of the invention will appear from the following description in which the preferred embodiment has been set forth in detail in conjunction with the accompanying drawings.

BRIEF DESCRIPTION OF THE DRAWINGS

FIG. 1 is an isometric view of the disclosed water sweeper.

FIG. 2 is a sectional view taken along the line 2—2 of FIG. 1.

FIG. 3 is a sectional view taken along the line 3—3 of FIG. 1.

DESCRIPTION OF THE PREFERRED EMBODIMENT

Figure 4:
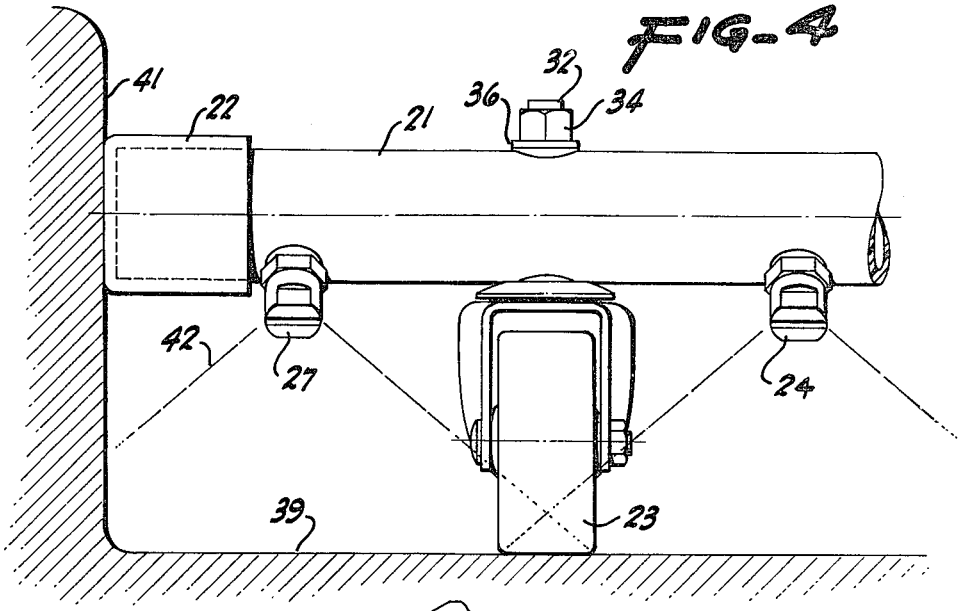
FIG. 4 is a partial front elevational view of the water sweeper.

FIG. 1 of the drawings shows the water sweeper or water broom generally at 11 attached to a hose 12 which is in turn coupled to a source of water or other suitable cleaning liquid under pressure (not shown). A handle member 13 is made of polyvinylchloride material or some suitable equivalent plastic material. Handle member 13 has a hose coupling 14 at one end thereof and is shown coupled to a hand actuated valve 16 in this embodiment. Valve 16 may be of the type having a lever 17 for opening the valve to allow water to pass therethrough under pressure. A preferred type of valve 16 provides lever 17 with a spring urging lever 17 to the closed position. In this fashion valve 16 must be manually operated to the open position and when manual pressure is removed from lever 17, the valve is closed. Valve 16 is, in turn, shown coupled through a standard hose coupling 18 to hose 12. The valve 16 enables an operator of the water sweeper to use and operate the sweeper with one hand.

A "T" type fitting 19 is attached to the end of handle member 13 opposite that carrying coupling 14. "T" fitting 19 is also fabricated of polyvinylchloride or some suitable equivalent plastic material. A cross member 21 is formed of lengths of similar plastic tubing inserted into the open ends of the "T" fitting on the cross member of the "T". A cross passage passes through the cross member 21 and is coupled to the handle passage at a junction within "T" fitting 19. An end cap 22 is sealed to each end of cross member 21 for sealing the flow path through handle member 13, "T" fitting 19 and cross member 21. Alternatively, cross member 21 and handle member 13 may be formed as an integral part without "T" fitting 19.

Support means comprising a pair of casters 23 are mounted toward each end of cross member 21 from "T" fitting 19 for contact with the underlying surface to be cleaned. A plurality of spray nozzles 24 are mounted in a front portion of the wall of cross member 21. A center spray nozzle 26 is mounted in "T" fitting 19 extending into the junction between the handle passage in handle member 13 and the cross passage in cross member 21. Additional spray nozzles 27 are shown mounted near the ends of cross member 21 outside of the mounting for casters 23. Spray nozzles 24, 26 and 27 are similar, being of the VEEJET* type H-U, VV and U manufactured by Spraying Systems Company of Wheaton, Ill., and are provided different item numbers to facilitate further descriptions hereinafter. Spray nozzles 24, 26 and 27 are shown providing flat spray patterns which are directed toward the underlying surface and which overlap thereon when handle 13 is held at a predetermined elevation above and in predetermined angular relationship to the underlying surface to be cleaned. Consequently, a continuous spray jet of water is provided by spray nozzles 24, 26 and 27 which extends laterally at least as far as the ends of each end cap 22.

*TRADE NAME

One manner in which each caster 23 is mounted near each end of cross member 21 is illustrated in FIG. 2. A hole 28 is formed through the upper and lower walls of cross member 21 at the mounting point for caster 23. A sleeve 29, also fabricated of polyvinylchloride or some similar suitable plastic material, is formed which passes through hole 28 and is inserted through hole 28 to extend slightly above and below the outer surface of cross member 21. Sleeve 29 has bore 31 therethrough which is formed to accept a swivel pin 32 attached to caster 23. Swivel pin 32 has threads 33 at the upper end thereof formed to mate with the threads in a nut 34. A washer 36 is placed over the upper end of swivel pin 32 and nut 34 is drawn thereon, thereby exerting an axial force against washer 36 and sleeve 29. Sleeve 29 thereby expands in cross section coming into sealable contact with the boudaries of hole 28 and further forming a lip 37 at the upper and lower ends of sleeve 29 further enhancing the seal between the boundaries of hole 28 and the outer surface of sleeve 29. In this fashion, caster 23 is mounted near the outer ends of cross member 21, but is isolated from the cross passage within cross member 21 and the water flow therethrough. Sleeve 29 thus separates pin 32 from fluid passing through cross member 21 to thereby prevent rust formation or other clogging deposits in the cross member.

Turning now to FIG. 3, center spray nozzle 26 is shown extending through the wall of "T" fitting 19 and into the junction therein between the handle passage through handle member 13 and the cross passage through cross member 21. Water flow proceeding in the direction of arrow 38 within handle passage 13 enters the junction between the handle and cross passages and impinges on the inlet end of center spray nozzle 26 extending into the junction. The presence of the inlet end of center spray nozzle 26 in the flow coming from the handle passage in handle member 13 diverts the flow at the junction with "T" fitting 19 to flow toward each end of cross member 21. This diversion affect produced by the inlet end of center spray nozzle 26 reduces head loss within "T" fitting 19 as the flow changes direction from the handle passage to the cross passage. Consequently, available water pressure at spray nozzles 24 and 27 is sustained at a higher level.

FIG. 4 shows an underlying surface 39 with an obstruction 41 at the edge thereof, such as a curb. Additional spray nozzle 27 is shown mounted in the wall of cross member 21 sufficiently close to end cap 22 so that a flat fan shaped spray pattern 42 emanating from spray nozzle 27 extends laterally to a point on surface 39 underlying the extreme lateral boundary of end cap 22. In this fashion, surface 39 may be cleaned by the continuous flat impinging spray pattern from spray nozzles 24, 26 and 27 for the entire width of cross member 21 and end caps 22. This extension of fan shaped spray pattern 42 beyond the end of end cap 22 and the overlapping to form a continuous spray pattern across the width of the water broom 11, presupposes an elevation of handle member 13 which does not exceed a predetermined angle $\alpha$ as seen in FIG. 3. A typical angle $\alpha$ for obtaining the continuous flat spray pattern from the plurality of spray nozzles is approximately 50° for this embodiment. This would depend to some extent of course on the common direction in which spray nozzles 24, 26 and 27 are directed from cross member 21.

Figure 5:
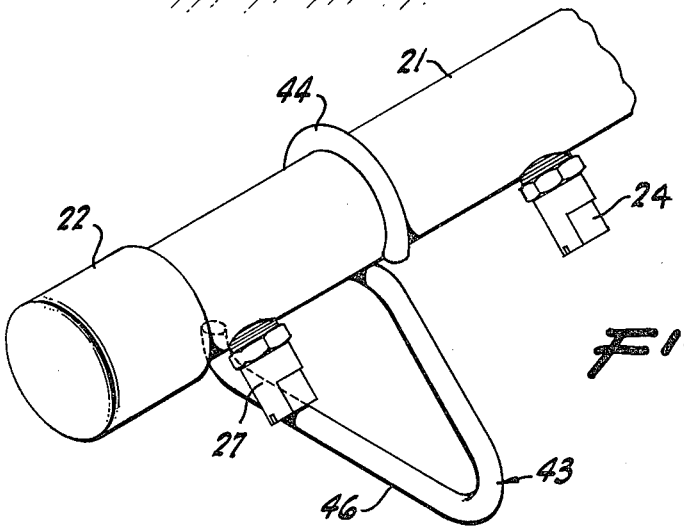
FIG. 5 is a partial isometric view of an alternate embodiment of the water sweeper.

FIG. 5 shows an alternate embodiment wherein casters 23 are replaced by other support means defined by skids 43. As seen in FIG. 5 skid 43 has one end 44 which is formed to surround the circumference of cross member 21 at a position between additional spray nozzle 27 and adjacent spray nozzle 24. Thus, cross member 21 is allowed to rotate within the surrounding portion 44 of skid 43 as handle member 13 is elevated and depressed. A lower portion 46 on skid 43 contacts the underlying surface for sliding thereon. Skid 43 is trapped laterally between spray nozzles 24 and 27 and is formed so as not to interfere with the spray patterns emitted therefrom. Since, in the preferred embodiment, all of the parts are plastic except the couplings and spray nozzles which are brass, water broom 11 is relatively light and may be slid back and forth on skids 43 and moved laterally with slight sideways hand pressure.

Figure 6:
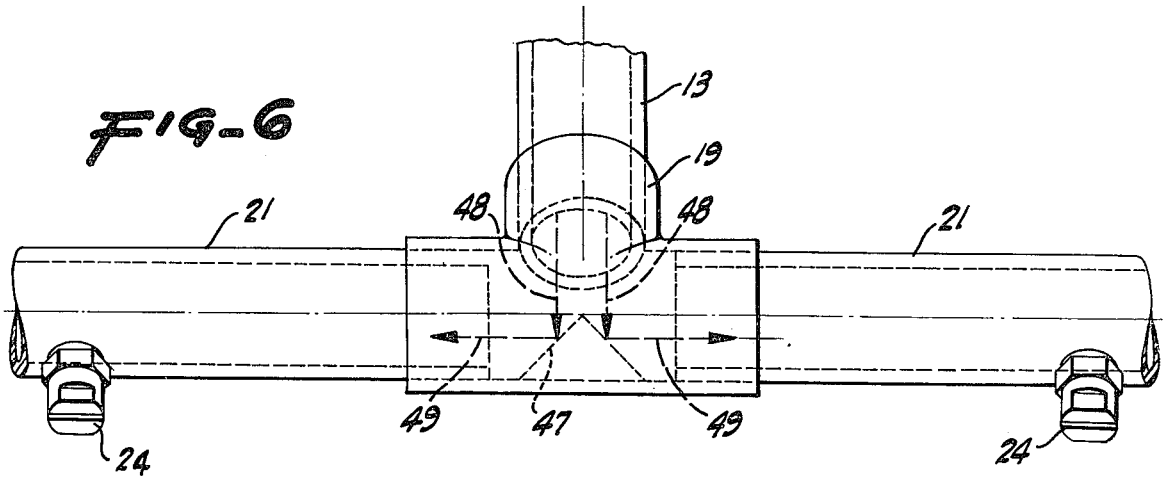
FIG. 6 is a partial elevational view of an additional embodiment of the water sweeper.

FIG. 6 shows an alternate embodiment for accomplishing the beneficial effect afforded by center spray nozzle 26. Prior to assembly a deflection member 47 is fixed in place within "T" fitting 19 in line with the passage through the upright leg of the "T". Flow depicted by arrows 48 entering the junction between the handle and the cross passages is deflected by deflection member 47 as shown by arrows 49. In this fashion, flow is deflected into the cross passage toward each end of cross member 21 with reduced head loss. The aforementioned advantage of sustained pressure at spray nozzles 24 and 27 is thereby obtained in an alternate fashion than that described in conjunction with FIG. 3.

A water sweeper or water broom has been disclosed which is self-supported on an underlying surface to be cleaned, and which provides a flat continuous spray pattern across the width of the broom, thereby minimizing the volume of water impinging on the surface for cleaning. A valve used in conjunction with the water sweeper further controls the volume of water for cleaning to thereby leave a minimal amount standing on the surface when cleaning is completed. The disclosed water sweeper is capable of cleaning the entire surface in spite of obstructions located at the edges of the surface.

It is understood that the disclosed water broom may be used to dispense cold or hot water with or without detergent, or to dispense any other cleaning solvent or chemical solution when fabricated of appropriate materials.

Having thus made a full disclosure of preferred embodiments of the water sweeper constituting this invention, reference is directed to the appended claims for the scope of protection to be afforded thereto.

What is claimed is:

1. A surface cleaning apparatus for use with a hose connected to a liquid supply, comprising a handle member having a handle passage therethrough and adapted to connect to the hose at one end, a cross member having a cross passage therethrough in a communication with said handle passage, said cross member extending laterally from and being connected to the other end of said handle member at a junction spaced from each end of said cross member, means for sealing each end of said cross member, means for supporting said cross member in spaced relation with the surface, supporting means comprising first and second casters, swivel pins extending from each of said first and second casters, first and second holes through said cross member on opposite sides of said junction, a deformable sleeve in each of said first and second holes formed to receive said swivel pins, said swivel pins extending through said deformable sleeves, and fastening means operating to engage the ends of said swivel pins and to exert an axial force against said deformable sleeves, whereby said sleeves expand in cross section to sealably engage the boundaries of said first and second holes and said casters are secured therein, and a plurality of spray nozzles mounted in said cross member for directing a plurality of overlapping spray patterns onto the surface, said overlapping spray patterns extending laterally at least to the ends of said cross member, whereby liquid from said supply is directed through said handle passage, is diverted toward each end of said cross passage from said junction and through said spray nozzles at substantially equal pressure to impinge on the surface, thereby loosening and removing debris therefrom.

2. A surface cleaning apparatus as in claim 1 wherein said spray nozzles have an inlet end and a nozzle end, one of said plurality of spray nozzles being mounted at said junction with said inlet end extending into said cross passage and operating to deflect liquid flow from said handle passage toward each end of said cross passage, thereby diminishing head loss at said junction.

3. A surface cleaning apparatus as in claim 1 wherein said spray nozzles produce an elongate spray pattern extending parallel to said cross member, ones of said spray nozzles being mounted close to each end of said cross member, so that said elongate spray pattern extends at least to a point on the surface corresponding to the ends of said cross member, whereby the spray pattern impinges on the entire surface in spite of side obstructions adjacent thereto.

4. A surface cleaning apparatus as in claim 1 wherein said handle member includes a valve for manually controlling water flow.

5. A surface cleaning apparatus as in claim 1 together means mounted in said cross passage at said junction diverting flow from said handle passage to each end of said cross passage and reducing head loss at said junction.

6. A water broom for use with a hose attached to a liquid supply, comprising a broom handle adapted at one end to couple to the hose and having a handle passage therethrough, a broom cross member attached to the other end of said broom handle extending on opposite sides thereof and having a cross passage in communication with said handle passage, a sealing cap on each end of said broom cross member, a plurality of spray jets mounted in said broom cross member each providing an elongate spray pattern extending in a direction parallel to said cross member and directed in a substantially common direction therefrom, said spray patterns overlapping at a predetermined distance from said cross member, first and second casters attached to opposing ends of said cross member for supporting said cross member for movement on an underlying surface and for spacing said cross member therefrom, whereby water from the supply directed with force in a thin elongate jet on the underlying surface to loosen debris and dirt thereon and to move debris and dirt ahead of the jet, said cross member having first and second through holes near the ends thereof, together with a deformable sleeve extending through each of said through holes, a swivel pin on each of said first and second casters formed to pass through said deformable sleeve and having end threads, a nut cooperating with said end threads causing said sleeve to expand in cross section to sealably engage the boundaries of said holes, thereby isolating said swivel pins from water flow within said cross passage and securing said casters in said cross member.

7. A water broom as in claim 6 wherein ones of said plurality of spray jets are mounted close to each end of said broom cross member so that said elongate spray pattern reaches at least to the plane of the end of said sealing cap at said predetermined distance, whereby the entire underlying surface receives said spray pattern when side obstructions are adjacent thereto.

8. A water broom as in claim 6 wherein one of said plurality of spray jets is positioned in line with said broom handle, said one spray jet having an inlet end and a nozzle end, said inlet end extending into said cross passage and serving to deflect flow from said handle passage into the opposite sides of said cross passage thereby reducing head loss at the junction of said handle and cross passages, whereby greater force is available in the thin elongate jet for impinging on the underlying surface.

* * * * *